US007943876B2

(12) United States Patent
Kim et al.

(10) Patent No.: US 7,943,876 B2
(45) Date of Patent: May 17, 2011

(54) LIGHT EMITTING APPARATUS FOR CLOTHING HANDLER

(75) Inventors: Hyo-Jin Kim, Gyeongsangnam-Do (KR); Ho-Sung Jang, Gyeongsangnam-Do (KR); Jae-Cheol Lyu, Gyeongsangnam-Do (KR); Han-Ki Cho, Gyeongsangnam-Do (KR); Chang-Woo Son, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 401 days.

(21) Appl. No.: 12/104,867

(22) Filed: Apr. 17, 2008

(65) Prior Publication Data

US 2008/0259591 A1 Oct. 23, 2008

(30) Foreign Application Priority Data

Apr. 20, 2007 (KR) ..... 10-2007-0039029

(51) Int. Cl.
*H01H 9/18* (2006.01)

(52) U.S. Cl. ..... 200/310; 200/296; 200/313; 200/317

(58) Field of Classification Search ..... 200/5 R, 200/5 A, 310–317, 296
See application file for complete search history.

(56) References Cited

U.S. PATENT DOCUMENTS

| | | | | |
|---|---|---|---|---|
| 5,874,901 | A * | 2/1999 | Ohyama | 340/815.42 |
| 5,982,103 | A * | 11/1999 | Mosebrook et al. | 315/149 |
| 6,627,829 | B2 * | 9/2003 | Sato | 200/310 |
| 6,750,407 | B2 * | 6/2004 | Song et al. | 200/5 A |
| 7,180,023 | B2 * | 2/2007 | Seo | 200/329 |
| 7,222,979 | B1 * | 5/2007 | Popowich et al. | 362/26 |
| 7,554,463 | B2 * | 6/2009 | Ulius-Sabel et al. | 341/22 |
| 7,598,885 | B2 * | 10/2009 | Kwon et al. | 340/815.45 |
| 7,629,548 | B2 * | 12/2009 | Pippel et al. | 200/344 |
| 7,670,039 | B2 * | 3/2010 | Altonen et al. | 362/555 |
| 2005/0183471 | A1 | 8/2005 | Kang et al. | |

FOREIGN PATENT DOCUMENTS

| | | |
|---|---|---|
| CN | 1477257 | 2/2004 |
| DE | 24 13 649 | 10/1975 |
| DE | 101 47 793 | 2/2003 |
| DE | 10 144 668 | 3/2003 |
| DE | 103 09 823 | 9/2004 |
| DE | 10 2006 023 959 | 1/2007 |
| GB | 2 008 286 | 5/1979 |
| JP | 2006-190597 | 7/2006 |
| KR | 10-2005-0086199 | 8/2005 |

OTHER PUBLICATIONS

Chinese Office Action dated Feb. 24, 2010.
German Office Action dated Apr. 9, 2010.
Korean Office Action dated Aug. 29, 2008.
Chinese Office Action dated Jan. 31, 2011. (Application No. 200810142867.5).

* cited by examiner

*Primary Examiner* — Michael A Friedhofer
(74) *Attorney, Agent, or Firm* — KED & Associates LLP

(57) ABSTRACT

A light emitting apparatus is provided for a clothing handler that handles clothes received therein. The light emitting apparatus includes a selection device that selects processes for handling the clothes, light emitting devices that emit light according to a selection by the selection device, a transparent window that covers light emitting devices, and a selection device guiding member having holes through which light generated by the light emitting devices, respectively, passes. An end portion of each of the holes is adjacent to the transparent window based on a proceeding direction of the light. The transparent window includes protrusion portions that contact an inner wall of the corresponding hole of the selection device guiding member.

10 Claims, 6 Drawing Sheets

LIGHT EMITTING APPARATUS FOR CLOTHING HANDLER

BACKGROUND OF THE INVENTION

1. Field of the Invention

The present invention relates to a clothing handler, and more particularly, to a light emitting apparatus for a clothing handler.

2. Description of the Related Art

Clothing handlers serve to perform each kind of process for clothing and include washing machines, dryers and so on.

The clothing handler is provided with a control panel. The control panel includes a plurality of buttons for applying a power and inputting processes for handling clothes, and a plurality of LED (Light Emitting Diode) devices emitting light so as to display a function corresponding to a selected button. And, in order to protect the LED devices from an outside, a plurality of transparent windows covering each LED device are installed.

However, in the related clothing handler, since each transparent window covering each LED device is small, light emitting efficiency of the LED devices is deteriorated and a user cannot easily recognize whether or not light is emitted from a corresponding LED device.

SUMMARY OF THE INVENTION

Therefore, the present invention is directed to providing a light emitting apparatus for a clothing handler in which a structure of a transparent window covering light emitting devices is enhanced so as to easily recognize whether or not light is emitted from the light emitting devices.

To achieve these and other advantages and in accordance with the purpose of the present invention, as embodied and broadly described herein, there is provided a light emitting apparatus for a clothing handler handling clothes received therein, the light emitting apparatus comprising: selection means for selecting processes for handling the clothes in a pressing manner, a plurality of light emitting devices arranged at a periphery of the selection means so as to emit light according to a selection by the selection means, and a transparent window covering the plurality of light emitting devices.

In accordance with another aspect of the present invention, there is provided a light emitting apparatus for a clothing handler handling clothes received therein, the light emitting apparatus comprising: selection means for selecting processes for handling the clothes, a plurality of light emitting devices emitting light according to a selection of the selection means, a transparent window covering the plurality of light emitting devices, and a selection means guiding member having a plurality of holes through which light generated from the plurality of light emitting devices respectively passes and guiding an operation of the selection means. Here, each end portion of the holes may be adjacent to the transparent window based on a proceeding direction of the light.

In accordance with still another aspect of the present invention, there is provided a light emitting apparatus for a clothing handler handling clothes received therein, the light emitting apparatus comprising: selection means for selecting processes for handling the clothes, a plurality of light emitting devices emitting light according to a selection by the selection means, and a transparent window covering the plurality of light emitting devices.

According to the light emitting apparatus for the clothing handler of the present invention, by the transparent window covering the plurality of light emitting devices, an area of the transparent window allocated to each light emitting device is enlarged, accordingly it is capable of increasing the amount of light outwardly transmitted, thereby being capable of easily recognizing whether or not light is emitted from the light emitting devices from an outside.

Further, according to the light emitting apparatus for the clothing handler, the transparent window is integrally formed, thereby being capable of implementing an excellent appearance, of easily handling the transparent window, and of reducing time and costs spent on a coupling process.

Further, according to the light emitting apparatus for the clothing handler, a button guiding member forming a light guiding unit and the transparent window are disposed to be adjacent to each other, accordingly it is capable of minimizing interference between the light passing through the light emitting holes of each light guiding unit. Therefore, by integrally forming the transparent window, the area of the transparent window allocated to each light emitting device is enlarged, accordingly it is capable of enhancing light emitting efficiency resulting from preventing interference between light generated from each light emitting device, as well as of increasing the amount of light outwardly transmitted and implementing the excellent appearance.

Further, according to the light emitting apparatus of the clothing handler, by the mis-assembly preventing protrusions and the mis-assembly preventing holes formed to be coupled to each other, it is capable of preventing mis-assembly of the buttons when the buttons are respectively coupled to the button guiding member. Accordingly, it is capable of reducing time and costs spent on a process for fixing the mis-assembly of the buttons and of preventing mal-operation of the clothing handler resulting from selecting a mis-assembled button.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate preferred embodiments of the invention and together with the description serve to explain the principles of the invention.

In the drawings.

DETAILED DESCRIPTION OF THE INVENTION

Hereafter, description will now be given in detail of the preferred embodiments of the present invention, examples of which are illustrated in the accompanying drawings.

Here, a light emitting apparatus in accordance with the present invention is disclosed to applied to a control panel of a clothing handler, however, it may be applied to other components of the clothing handler.

Figure 1:
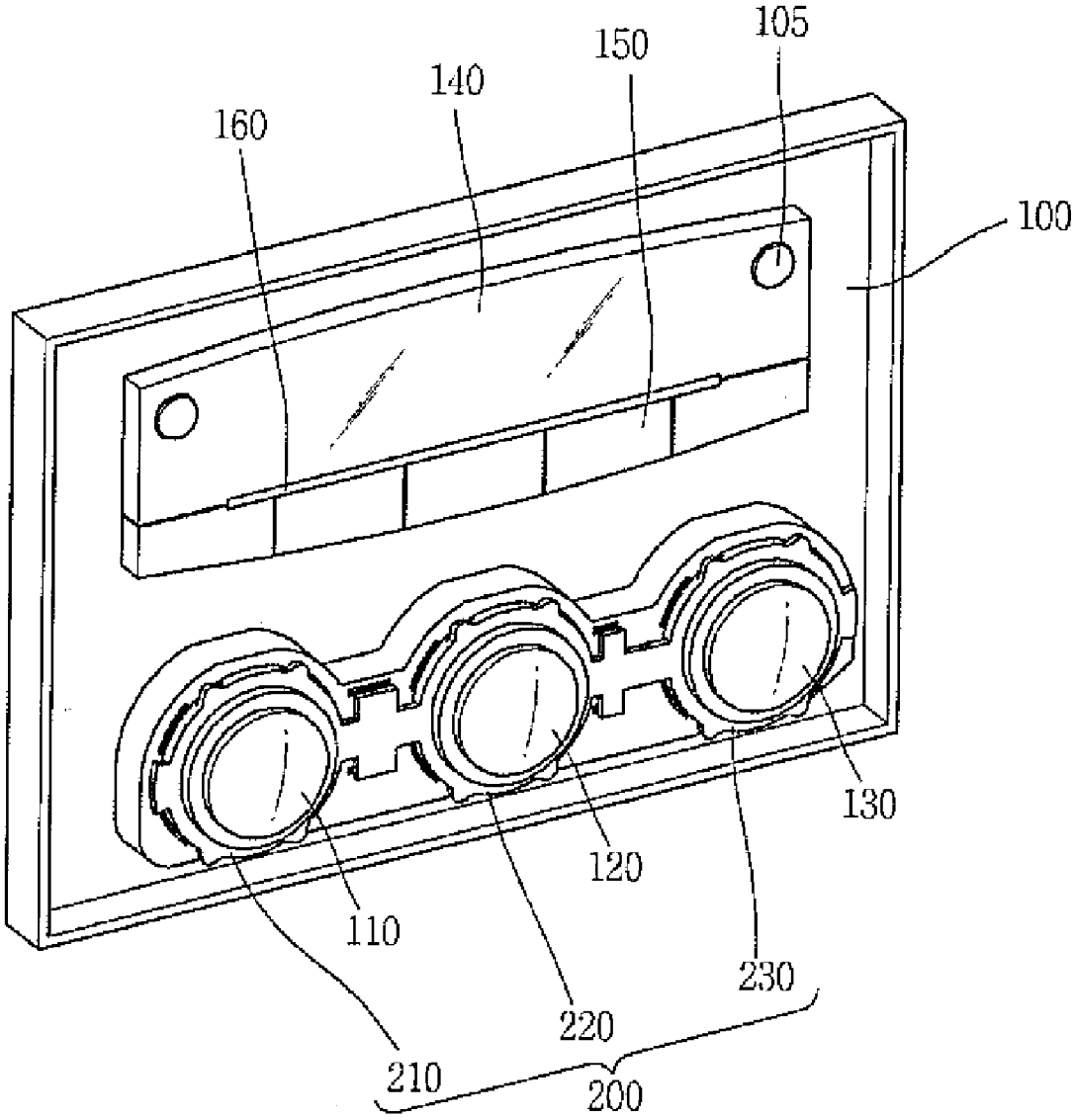
FIG. 1 is a front perspective view showing a control panel of a clothing dryer having a light emitting apparatus in accordance with a first embodiment of the present invention.
Figure 2:
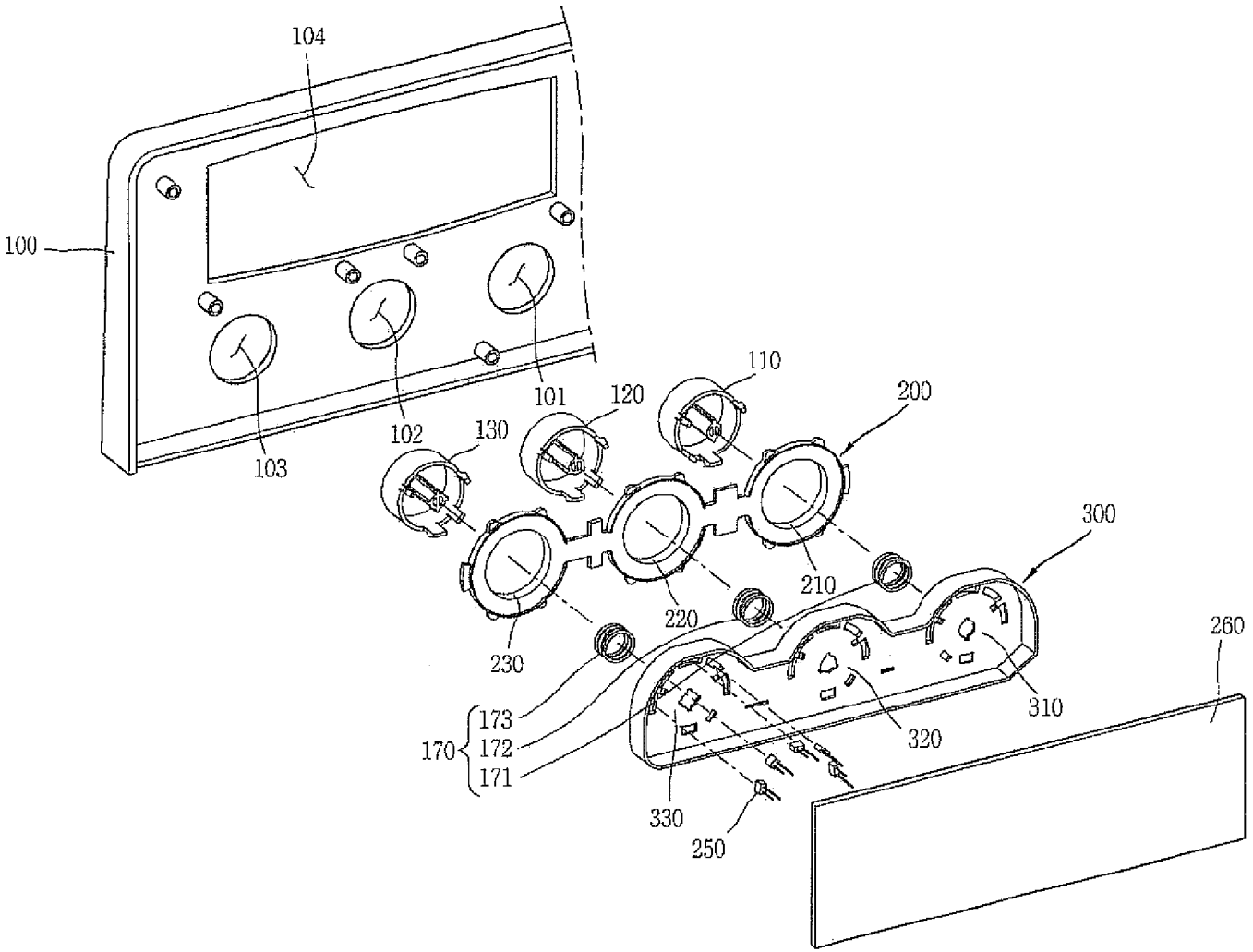
FIG. 2 is an exploded rear perspective view showing the light emitting apparatus in accordance with the first embodiment of the present invention.

FIG. 1 is a front perspective view showing a control panel of a clothing handler having a light emitting apparatus in accordance with a first embodiment of the present invention, and FIG. 2 is an exploded rear perspective view showing the light emitting apparatus in accordance with the first embodiment of the present invention.

Referring to FIGS. 1 and 2, the light emitting apparatus of this embodiment may be installed on the control panel 100 of the clothing handler. A substrate unit 260 on which various circuits are formed is disposed at a rear side of the light emitting apparatus. Reference numerals 140 and 150 indicate a display window and rectangular buttons disposed at an upper side of the light emitting apparatus on the control panel 100.

The light emitting apparatus includes circular buttons 110, 120, 130, a transparent window 200, a button guiding member 300, and a plurality of light emitting devices 250.

Particularly, the circular buttons consists of a first circular button 110, a second circular button 120 and a third circular button 130. Options for handling clothes may be inputted by each circular button 110, 120, 130 and each corresponding portion of the substrate unit 260, respectively. And, the number of times each button 110, 120, 130 is pressed may determine options to be inputted for handling clothes.

The circular buttons 110, 120, 130 may be defined as selection means for selecting various processes for handling clothes, for example, applying of power, selecting of a course, etc. in the clothing handler. According to the number of times the circular buttons 110, 120, 130 are pressed by a user, a corresponding process is selected.

The control panel 100 is provided with insertion holes 101, 102, 103 into which the circular buttons 110, 120, 130 are respectively inserted to be operated.

The plurality of light emitting devices 250 can emit light separately or collectively. Each of the plurality of light emitting devices 250 is disposed at each periphery of the circular buttons 110, 120, 130 in a group, respectively.

The light emitting devices 250 are controlled to emit light according to the number of times the corresponding one of circular buttons 110, 120, 130 is pressed. The emitting of light may be implemented as a manner that one light emitting device 250 corresponding to the number of times the corresponding one of circular buttons 110, 120, 130 is pressed emits light and a manner that the light emitting devices 250 emit light accumulatively corresponding to the number of times the corresponding one of circular buttons 110, 120, 130 is pressed. Here, the manner accumulatively emitting light may include a manner that the light emitting devices 250 consecutively emit light as the number of times the button is pressed is increased.

The transparent window 200 consists of a first button window 210, a second button window 220 and a third button window 230. The button windows 210, 220, 230 are connected to each other, thus implement a single transparent window 200. The transparent window 200 covers the plurality of light emitting devices 250. Thus, it may facilitate disposing the light emitting devices 250 and the transparent window 200, and a coupling structure therebetween may be simple.

Each of the circular buttons 110, 120, 130 penetrates each of the button windows 210, 220, 230 of the transparent window 200 to be operated. And, a protruded front portion of each button window 210, 220, 230 and each circular button 110, 120, 130 are respectively inserted into the insertion holes 101, 102, 103, thus may be outwardly exposed.

The button guiding member 300 guides an operation of each circular button 110, 120, 130 so as to facilitate a pressing operation of the circular buttons 110, 120, 130. The button guiding member 300 consists of a first button guiding unit 310, a second button guiding unit 320 and a third button guiding unit 330. The button guiding member 300 can be defined as a selection means guiding member.

The circular buttons 110, 120, 130 are coupled to the front surface of the button guiding member 300. And, the transparent window 200 is coupled to the front surface of the button guiding member 300 with covering the plurality of light emitting devices 250.

In order to facilitate the coupling process, after the circular buttons 110, 120, 130 are coupled to the button guiding member 300, the transparent window 200 covers the plurality of light emitting devices 250 so as to be coupled to the button guiding member 300.

The light emitting devices 250 may be installed at a rear side of the button guiding member 300 toward a front side thereof.

A spring 170, an elastic member, is mounted between the button guiding member 300 and the circular buttons 110, 120, 130. After released from pressing for the circular buttons 110, 120, 130, the spring 170 provides an elastic force so that the circular buttons 110, 120, 130 can be moved into its original positions.

Figure 3:
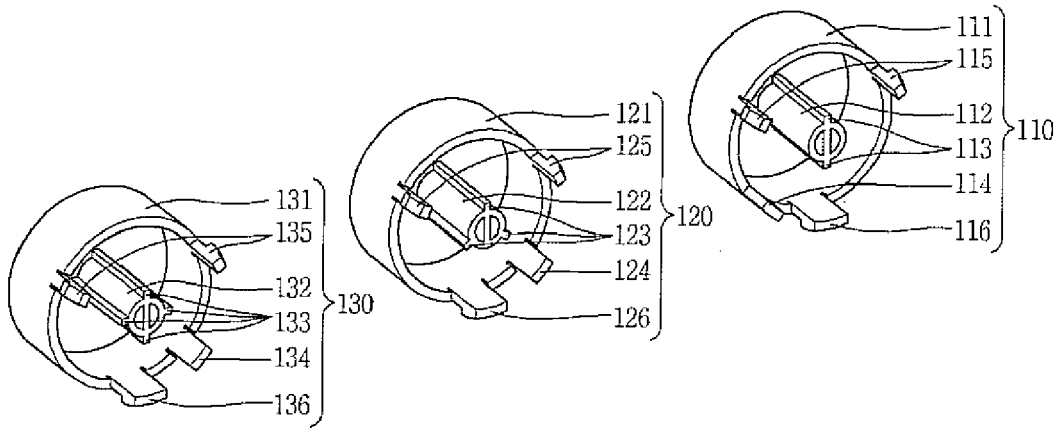
FIG. 3 is a rear perspective view showing circular buttons applied to the light emitting apparatus in accordance with the first embodiment of the present invention.

FIG. 3 is a rear perspective view showing circular buttons applied to the light emitting apparatus in accordance with the first embodiment of the present invention.

Referring to FIG. 3, the circular buttons 110, 120, 130 of this embodiment are respectively provided with button bodies 111, 121, 131, supporting shafts 112, 122, 132, first misassembly preventing protrusions 113, 123, 133, second misassembly preventing protrusions 114, 124, 134, upper coupling hooks 115, 125, 135, and lower coupling hooks 116, 126, 136.

Each button body 111, 121, 131 has a specific area so as to be pressed by the user.

Each supporting shaft 112, 122, 132 is extended from a rear middle portion of each button body 111, 121, 131, thus respectively inserted into specific portions of the button guiding member 300. The supporting shafts 112, 122, 132 support the button bodies 111, 121, 131, and guide moving of the button bodies 111, 121, 131 when the button bodies 111, 121, 131 are pressed.

The first mis-assembly preventing protrusions 113, 123, 133 are provided at the supporting shafts 112, 122, 132 with different positions and shapes from each other. The first mis-assembly preventing protrusions 113, 123, 133 may be provided at the supporting shafts 112, 122, 132 with same positions and shapes to each other in a length direction thereof so as to be inserted into specific portions of the button guiding member 300 to be slidable.

As shown in FIG. 3, the first mis-assembly preventing protrusion 113 may be protruded from the supporting shaft 112 of the first circular button 110 in a vertical direction. The first mis-assembly preventing protrusion 123 may be protruded from the supporting shaft 122 of the second circular button 120 in three directions at an interval of approximately 120° therebetween. And, the first mis-assembly preventing protrusion 133 may be protruded from the supporting shaft 132 of the third circular button 130 in four directions at an interval of approximately 90° therebetween.

The button guiding member 300 may be provided with protrusion penetrating holes corresponding to the first mis-assembly preventing protrusions 113, 123, 133, respectively. Thus, when coupling the circular buttons 110, 120, 130 to the button guiding member 300, each of the first mis-assembly preventing protrusions 113, 123, 133 is coupled to the corresponding protrusion penetrating hole, thereby being capable of preventing the circular buttons 110, 120, 130 from being mis-assembled. Accordingly, it is capable of reducing time and costs spent on a process for fixing the mis-assembly of the circular buttons 110, 120, 130, thereby being capable of preventing mal-operation of the clothing handler resulting from selecting a mis-assembled button.

The second mis-assembly preventing protrusions 114, 124, 134 are respectively formed at positions spaced from the supporting shafts 112, 122, 132 by a specific distance, for example, edge portions of each button body 111, 121, 131. The second mis-assembly preventing protrusions 114, 124, 134 are formed at different positions with different shapes so as to prevent the circular buttons 110, 120, 130 from being mis-assembled.

As shown in FIG. 3, each second mis-assembly preventing protrusion 114, 124, 134 may be formed on different hemispheres of the circular buttons 110, 120, 130 when vertically partitioned based on a center of each circular button 110, 120, 130. The second mis-assembly preventing protrusions 114, 124, 134 may be formed at different positions on the same hemisphere.

The upper coupling hooks 115, 125, 135 and the lower coupling hooks 116, 126, 136 are coupled to upper hook coupling holes 315, 325, 335 and lower hook coupling holes 317, 327, 337, respectively, so as to prevent each circular button 110, 120, 130 from being separated from the button guiding member 300.

The upper coupling hooks 115, 125, 135 and the lower coupling hooks 116, 126, 136 are extended in the same shapes and have extended ends formed in a hook shape, thereby facilitating sliding of the circular buttons 110, 120, 130 and preventing the circular buttons 110, 120, 130 from being arbitrarily separated.

And, the upper coupling hooks 115, 125, 135 and the lower coupling hooks 116, 126, 136 are respectively protruded from each edge portion of the button bodies 111, 121, 131 at an interval of approximately 120° therebetween, thereby being capable of guiding an operation of the circular buttons 110, 120, 130 as well as of preventing the separation.

Figure 4:
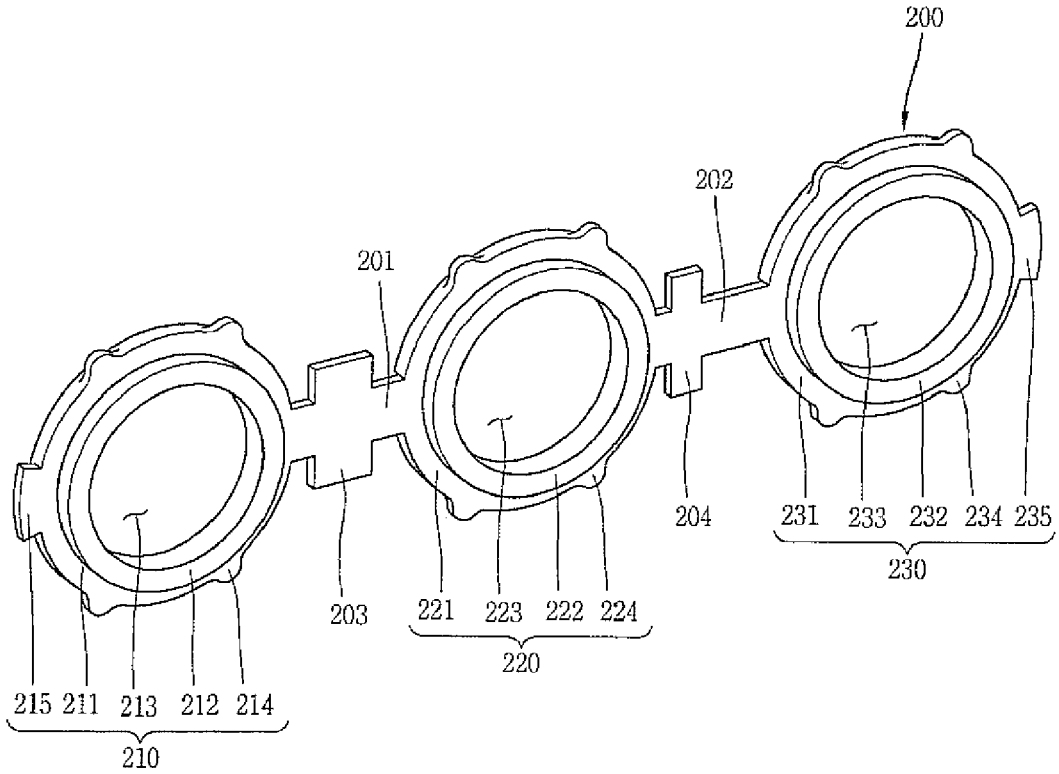
FIG. 4 is a front perspective view showing a transparent window applied to the light emitting apparatus in accordance with the first embodiment of the present invention.

FIG. 4 is a front perspective view showing the transparent window applied to the light emitting apparatus in accordance with the first embodiment of the present invention.

Referring to FIG. 4, the transparent window 200 of this embodiment includes a first button window 210, a second button window 220 and a third button window 230 connected to each other by a first connecting portion 201 and a second connecting portion 202.

Particularly, the first button window 210, the second button window 220 and the third button window 230 are provided with button window bodies 211, 221, 231, integrated device covers 212, 222, 232, button penetrating holes 213, 223, 233, first locking protrusions 214, 224, 234, and second locking protrusions 215, 225, 235.

The integrated device covers 212, 222, 232 are forwardly protruded from the button window bodies 211, 221, 231 and have rear sides provided with a plurality of light emitting devices 250 formed in a group, respectively. With such configuration, the integrated device covers 212, 222, 232 can cover the plurality of light emitting devices 250. Accordingly, an area of the transparent window 200 allocated to each light emitting device 250 may be enlarged, thereby being capable of increasing the amount of light outwardly transmitted and of implementing an excellent appearance. And, it is capable of facilitating handling for the transparent window 200 and of reducing time and costs spent on the coupling process.

The button penetrating holes 213, 223, 233 are portions through which each circular button 110, 120, 130 passes.

The first locking protrusions 214, 224, 234 and the second locking protrusions 215, 225, 235 are locked to specific portions of the button guiding member 300 so as for the transparent window 200 to be mounted onto the button guiding member 300. By the first locking protrusions 214, 224, 234 and the second locking protrusions 215, 225, 235, the transparent window 200 may be stable on the button guiding member 300.

Meanwhile, the first connecting portion 201 and the second connecting portion 202 are provided with a first window coupling protrusion 203 and a second window coupling protrusion 204. The first window coupling protrusion 203 and the second window coupling protrusion 204 are protruded in a direction different from an extended direction of the first connecting portion 201 and the second connecting portion 202, thus locked to specific portions of the button guiding member 300 so as to stably couple the transparent window 200.

And, the transparent window 200 may be formed to be semitransparent. Accordingly, light generated from the light emitting devices 250 is transmitted to an outside through the transparent window 200, thus the light emitting devices 250 cannot be shown at the outside, thereby being capable of implementing the excellent appearance.

Figure 5:
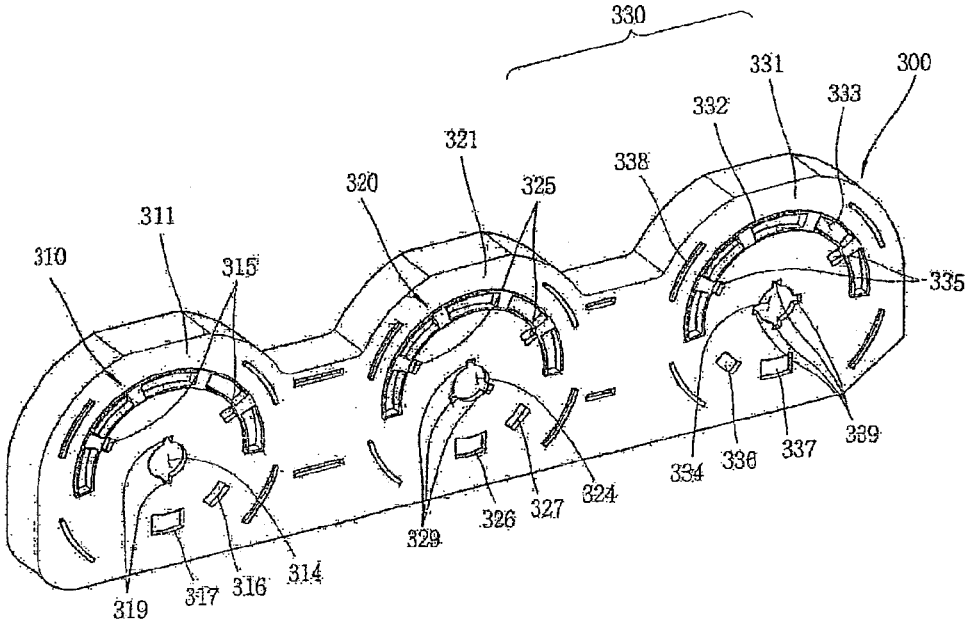
FIG. 5 is a perspective view showing a button guiding member applied to the light emitting apparatus in accordance with the first embodiment of the present invention.

FIG. 5 is a perspective view showing the button guiding member applied to the light emitting apparatus in accordance with the first embodiment of the present invention.

Referring to FIG. 5, the button guiding member 300 consists of a first guiding unit 310, a second guiding unit 320 and a third guiding unit 330.

Each guiding unit 310, 320, 330 respectively consists of guiding unit bodies 311, 321, 331, light emitting hole protrusion portions 312, 322, 332, light emitting holes 313, 323, 333, supporting shaft penetrating holes 314, 324, 334, the upper hook coupling holes 315, 325, 335, second mis-assembly preventing holes 316, 326, 336, the lower hook coupling holes 317, 327, 337, mounting hole forming protrusions 318, 328, 338 and first mis-assembly preventing holes 319, 329, 339.

The light emitting hole protrusion portions 312, 322, 332 are respectively protruded from the guiding unit bodies 311, 321, 331 by specific heights and provided with a plurality of light emitting holes 313, 323, 333.

The light emitting devices 250 are disposed at each rear side of the light emitting holes 313, 323, 333, thus light generated from the light emitting devices 250 is outwardly transmitted through the light emitting holes 313, 323, 333.

The light emitting holes 313, 323, 333 are formed at the light emitting hole protrusion portions 312, 322, 332 to be spaced from each other by a specific distance with having partition walls therebetween so as to prevent interference between the light.

In this embodiment, end portions protruded from the light emitting hole protrusion portions 312, 322, 332 are adjacent to the transparent window 200. Thus, light passing through the light emitting holes 313, 323, 333 of each light emitting hole protrusion portion 312, 322, 332 may not be interfered with each other. Accordingly, by integrally forming the transparent window 200, the area of the transparent window 200 allocated to each light emitting device 250 is enlarged, thus it is capable of increasing the amount of light outwardly transmitted and of implementing the excellent appearance, and at the same time, interference between the light generated from each light emitting device 250 is prevented, thereby being capable of enhancing light emitting efficiency.

The supporting shaft penetrating holes 314, 324, 334 are portions through which the supporting shafts 112, 122, 132 of the circular buttons 110, 120, 130 pass, respectively.

The first mis-assembly preventing holes 319, 329, 339 are formed at each periphery of the supporting shaft penetrating holes 314, 324, 334. The first mis-assembly preventing holes 319, 329, 339 are formed at positions corresponding to the first mis-assembly preventing protrusions 113, 123, 133 of the circular buttons 110, 120, 130 with shapes corresponding thereto.

And, the second mis-assembly preventing holes 316, 326, 336 are formed at positions spaced from the supporting shaft penetrating holes 314, 324, 334 by specific distances. The second mis-assembly preventing holes 316, 326, 336 are formed at positions corresponding to the second mis-assembly preventing protrusions 114, 124, 134 of the circular buttons 110, 120, 130 with shapes corresponding thereto.

With such configuration, the first mis-assembly preventing protrusions 113, 123, 133 and the second mis-assembly preventing protrusions 114, 124, 134 may pass through the first mis-assembly preventing holes 319, 329, 339 and the second mis-assembly preventing holes 316, 326, 336, respectively. Thus, each circular button 110, 120, 130 can be coupled to each guiding unit 310, 320, 330 of the button guiding member 300 without mis-assembly.

Here, the first mis-assembly preventing protrusions 113, 123, 133, the second mis-assembly preventing protrusions 114, 124, 134, the first mis-assembly preventing holes 319, 329, 339, and the second mis-assembly preventing holes 316, 326, 336 may be defined as a mis-assembly preventing unit.

The upper coupling hooks 115, 125, 135 and the lower coupling hooks 116, 126, 136 of the circular buttons 110, 120, 130 are respectively coupled to the upper hook coupling holes 315, 325, 335 and the lower hook coupling holes 317, 327, 337. Accordingly, each circular button 110, 120, 130 can remain stably coupled to each guiding unit 310, 320, 330 of the button guiding member 300 without arbitrary separation.

The mounting hole forming protrusions 318, 328, 338 are protruded from each edge portion of the guiding units 310, 320, 330 by specific heights so as to form mounting holes. In the mounting holes, each button window body 211, 221, 231, each mounting portion of the transparent window 200, is mounted and locked.

Here, the first locking protrusions 214, 224, 234 and the second locking protrusions 215, 225, 235 protruded from each button window body 211, 221, 231 are locked to the mounting hole forming protrusions 318, 328, 338.

With such configuration, it is capable of stably coupling the transparent window 200 to each guiding unit 310, 320, 330 of the button guiding member 300.

Here, the mounting hole forming protrusions 318, 328, 338, the button window bodies 211, 221, 231, the first window coupling protrusion 203 and the second window coupling protrusion 204 may be defined as a transparent window coupling unit.

Figure 6:
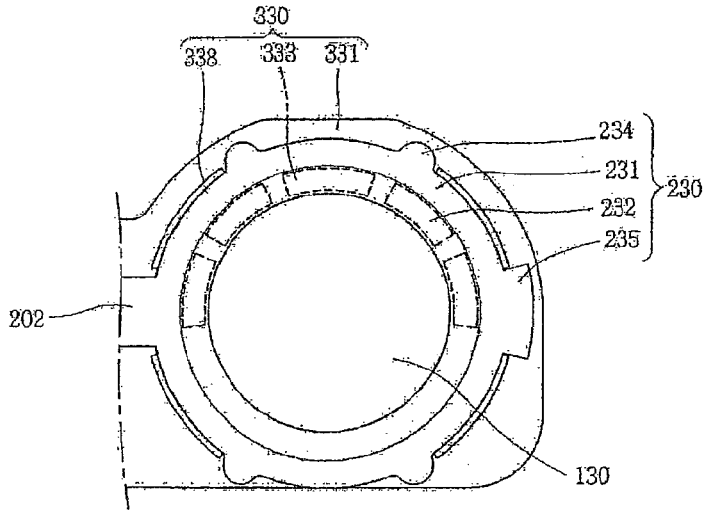
FIG. 6 is a front view showing the light emitting apparatus that is coupled in accordance with the first embodiment of the present invention.

FIG. 6 is a front view showing the light emitting apparatus that is coupled in accordance with the first embodiment of the present invention.

Referring to FIG. 6, in this embodiment, the third button window 230 of the transparent window 200 is coupled to the third guiding unit 330 of the button guiding member 300. This is merely exemplary and can be applied to other portions of the transparent window 200 and the button guiding member 300.

As shown, in accordance with this embodiment, the area of the transparent window 200 allocated to each light emitting device 250 may be enlarged and the transparent window 200 may easily and solidly coupled to the button guiding member 300.

Hereafter, other embodiments of the present invention will be described. Description of other embodiments same as that of the first embodiment will be omitted.

Figure 7:
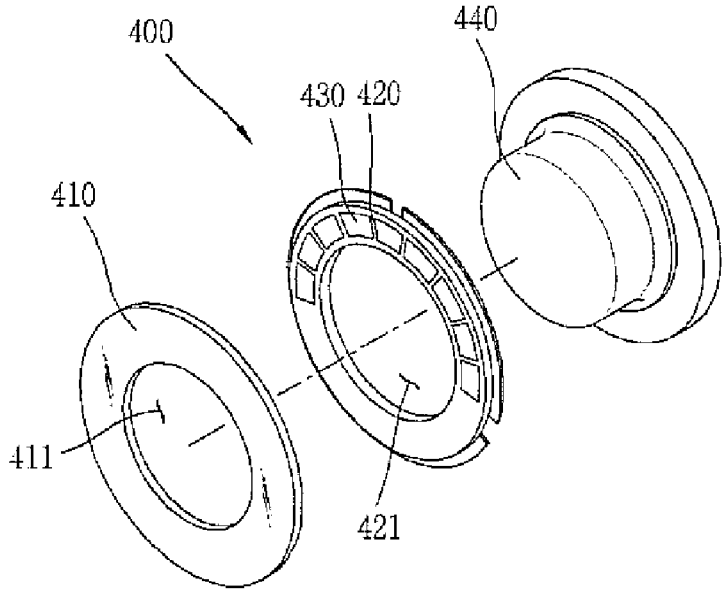
FIG. 7 is an exploded front perspective view showing a light emitting apparatus in accordance with a second embodiment of the present invention.

FIG. 7 is an exploded front perspective view showing a light emitting apparatus in accordance with the second embodiment of the present invention.

Referring to FIG. 7, a light emitting apparatus 400 in this embodiment includes a transparent window 410, a button guiding member 420, light emitting holes 430 and a dial knob 440.

The dial knob 440 is controlled to select processes according to a rotation angle. According to the process selected by the dial knob 440, light is emitted from the light emitting devices (not shown) disposed at the rear side of the light emitting holes 430.

In this embodiment, the transparent window 410 covers a plurality of light emitting holes 430 and the plurality of light emitting devices disposed at the rear side thereof. Accordingly, even in a manner applying the dial knob 440, the area of the transparent window 410 allocated to each light emitting device can be enlarged and the coupling process can be easily performed, by the transparent window 410.

Figure 8:
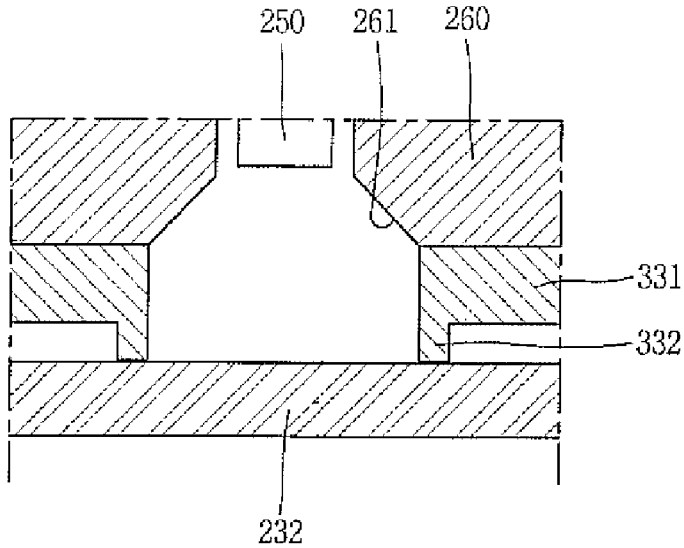
FIG. 8 is a schematic section view showing a light spreading prevention structure of the light emitting apparatus in accordance with the first embodiment of the present invention.

FIG. 8 is a schematic section view showing a light spreading prevention structure of the light emitting apparatus in accordance with the first embodiment of the present invention.

Referring to FIG. 8, in this embodiment, the light emitting device 250 is disposed at a hole formed at the substrate unit 260. The guiding unit body 331 of the button guiding member 300 is disposed at the front side of the substrate unit 260. And, the integrated device cover 232 of the transparent window 200 is disposed at the front side of the guiding unit body 331.

Here, the description brings the third guiding unit 330 and the third button window 230 into focus, but this is exemplary. And, it can be applied to other portions of the button guiding member 300 and the transparent window 200.

As shown, the substrate unit 260 guiding light generated from the light emitting device 250, the guiding unit body 331 and each peripheral portion of the light emitting holes of the integrated device cover 232 are adjacent to each other. Particularly, the light emitting hole protrusion portion 332 is protruded from the guiding unit body 331, thus is adjacent to the integrated device cover 232.

Since the substrate unit 260 guiding light generated from the light emitting device 250, the guiding unit body 331 and the integrated device cover 232 serve to guide the light generated from the light emitting device 250, they may be defined as a light guiding unit.

With such configuration, the light generated from the light emitting device 250 may be guided along the light emitting hole of the light guiding unit having few gap between each member, and then outwardly transmitted. Accordingly, it is capable of minimizing interference of light between the light emitting devices 250 neighboring with each other, thereby being capable of enlarging the allocating area of the transparent window 200 and of enhancing light emitting efficiency.

And, the light emitting hole protrusion portion 332 is protruded from the guiding unit body 331 by a specific height, accordingly it facilitates a molding process using the button guiding member 300.

Meanwhile, the substrate unit 260 may be provided with a light radiating portion 261 tapered to the light emitting device 250 in a fan shape. The light radiating portion 261 serves to radiate light generated from the light emitting device 250, thereby being capable of enhancing light emitting efficiency of the light emitting device 250.

Figure 9:
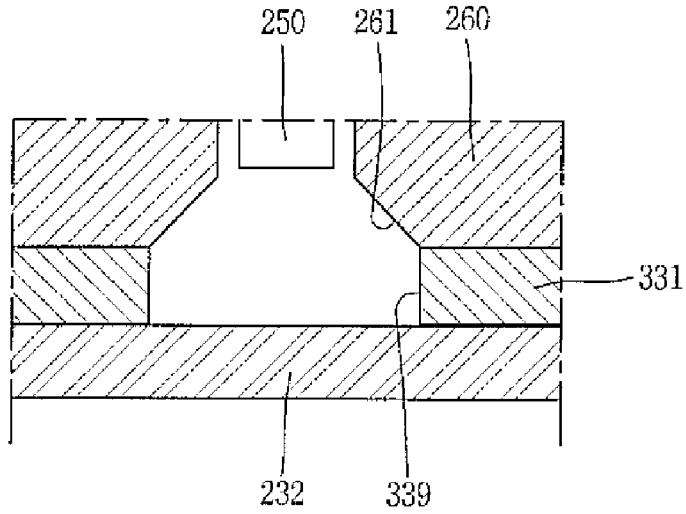
FIG. 9 is a schematic section view showing a light spreading prevention structure of a light emitting apparatus in accordance with a third embodiment of the present invention.

FIG. 9 is a schematic section view showing a light spreading prevention structure of a light emitting apparatus in accordance with a third embodiment of the present invention.

Referring to FIG. 9, in this embodiment, the substrate unit 260 forming the light guiding unit is adjacent to the guiding unit body 331 and the guiding unit body 331 is adjacent to the integrated device cover 232.

With such configuration, it is capable of simplifying a coupling structure between the substrate unit 260, the guiding unit body 331 and the device cover 232 as well as of enlarging the allocating area of the transparent window 200 and enhancing light emitting efficiency.

Figure 10:
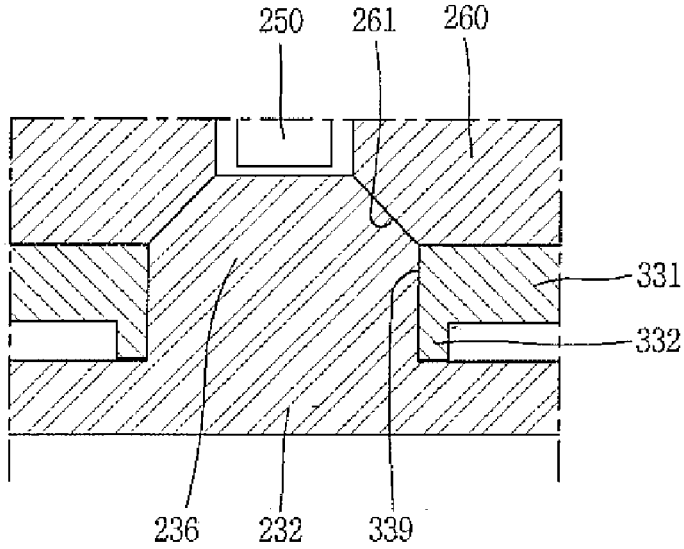
FIG. 10 is a schematic section view showing a light spreading prevention structure of a light emitting apparatus in accordance with a fourth embodiment of the present invention.

FIG. 10 is a schematic section view showing a light spreading prevention structure of a light emitting apparatus in accordance with a fourth embodiment of the present invention.

Referring to FIG. 10, in this embodiment, the substrate unit 260 forming the light guiding unit is adjacent to the guiding unit body 331 and the light emitting hole protrusion portion 332 protruded from the guiding unit body 331 is adjacent to the integrated device cover 232.

And, a protrusion portion 236 protruded toward the light emitting device 250, that is, into the hole of the light guiding unit is formed at the rear side of the integrated device cover 232.

With such configuration, by the protrusion portion 236, light generated from the light emitting device 250 can be easily transmitted to the outside through the light guiding unit, thereby being capable of enhancing light emitting efficiency.

According to the light emitting apparatus of the clothing handler in accordance with one aspect of the present invention, by the transparent window covering the plurality of light emitting devices, the area of the transparent window allocated to each light emitting device may be enlarged. Accordingly, the amount of light transmitted to the outside may be increased, thereby being capable of easily recognizing whether or not the light emitting devices emit light from the outside.

Further, according to the light emitting apparatus of the clothing handler, the transparent window is integrally formed, accordingly it is capable of having an excellent appearance, of facilitating handling for the transparent window, and of reducing time and costs spent on the coupling process.

Further, according to the light emitting apparatus of the clothing handler, the button guiding member forming the light guiding unit and the transparent window are disposed to be adjacent to each other, accordingly it is capable of minimizing interference between the light passing through the light emitting holes of each light guiding unit. Therefore, by integrally forming the transparent window, the area of the transparent window allocated to each light emitting device is enlarged, accordingly it is capable of enhancing light emitting efficiency resulting from preventing interference between the light generated from each light emitting device, as well as of increasing the amount of light outwardly transmitted and implementing the excellent appearance.

Further, according to the light emitting apparatus of the clothing handler, by the mis-assembly preventing protrusions and the mis-assembly preventing holes formed to be coupled to each other, it is capable of preventing mis-assembly of the buttons when the buttons are respectively coupled to the button guiding member. Accordingly, it is capable of reducing time and costs spent on a process for fixing the mis-assembly of the buttons and of preventing mal-operation of the clothing handler resulting from selecting a mis-assembled button.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present inventive features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A light emitting apparatus for a clothing handler that handles clothes received therein, the light emitting apparatus comprising:

a selection device that selects processes for handling the clothes;

a plurality of light emitting devices that emit light according to a selection by the selection device;

a transparent window that covers the plurality of light emitting devices; and a selection device guiding member having a plurality of holes through which light generated by the plurality of light emitting devices, respectively, passes, that guides an operation of the selection means, wherein an end portion of each of the plurality of holes is adjacent to the transparent window based on a proceeding direction of the light, and wherein the transparent window includes a plurality of protrusion portions that contacts an inner wall of the corresponding plurality of holes of the selection device guiding member.

2. The apparatus of claim 1, wherein the plurality of light emitting devices is controlled to emit light according to a number of times the selection device is pressed.

3. The apparatus of claim 2, wherein one light emitting device of the plurality of light emitting devices corresponding to the number of times the selection device is pressed, emits light.

4. The apparatus of claim 2, wherein the plurality of light emitting devices emit light in an accumulative manner, corresponding to the number of times the selection device is pressed.

5. The apparatus of claim 1, wherein the transparent window is integrally formed to entirely cover the plurality of light emitting devices.

6. The apparatus of claim 1, wherein the transparent window is semitransparent.

7. The apparatus of claim 1, wherein each peripheral portion of the plurality of holes neighboring with each other is spaced from each other by a specific distance so as to prevent interference between the light.

8. The apparatus of claim 1, wherein a light radiating portion is provided at a peripheral portion of the plurality of holes so as to radiate light generated from the plurality of light emitting devices.

9. The apparatus of claim 1, wherein a peripheral portion of the plurality of holes protrudes from the selection device guiding member by a specific height.

10. A clothes handler comprising the light emitting apparatus of claim 1.

* * * * *